United States Patent [19]

Ferrero et al.

[11] 4,053,003

[45] Oct. 11, 1977

[54] MACHINE FOR FILLING CONTAINERS

[75] Inventors: Oscar Adolfo Ferrero; Jorge Lorenzo Lodi, both of Buenos Aires, Argentina

[73] Assignee: The Coca-Cola Company, Atlanta, Ga.

[21] Appl. No.: 567,218

[22] Filed: Apr. 11, 1975

[30] Foreign Application Priority Data

Apr. 15, 1974 Argentina ..... 253295

[51] Int. Cl.[2] ..... B65B 43/52

[52] U.S. Cl. ..... 141/144; 141/168; 141/186; 141/238; 141/281

[58] Field of Search ..... 141/129–191, 141/281, 282, 237–246, 100–107; 198/480, 481, 598, 723

[56] References Cited

U.S. PATENT DOCUMENTS

| | | | |
|---|---|---|---|
| 1,330,596 | 2/1920 | Jackson et al. | 198/480 |
| 2,362,132 | 11/1944 | Haub | 198/723 |
| 2,440,866 | 5/1948 | Malhiot | 198/480 |
| 3,043,350 | 7/1962 | Stone | 141/281 |
| 3,155,125 | 11/1964 | Mojonnier et al. | 141/281 |
| 3,172,434 | 3/1965 | Boucher | 141/281 |

*Primary Examiner*—Houston S. Bell, Jr.
*Attorney, Agent, or Firm*—John R. Martin; W. Dexter Brooks; Robert A. Lester

[57] ABSTRACT

A machine is provided for filling containers with a liquid, which comprises a container infeed section, a container filling section and a container discharge section, the infeed section being equipped with empty container transfer means capable of receiving and releasing containers by twos in a substantially radial alignment with respect to the axis of the transfer means; the filling section comprising an annular tank for liquids, rotatable around its own symmetry axis, having a number of pairs of filling valves, the valves of each pair being arranged substantially over a radius of the said symmetry axis and having underneath each pair of valves support mechanism for containers, rotatable in conjunction with the valves, which receives containers from the transfer means in a first transfer section between the infeed and the filling sections, the support mechanisms comprising moreover apparatus capable of changing vertical position to connect and disconnect the mouth of the containers with the valves before the containers arrive at a second transfer section between the filling and the discharge sections; and a discharge means for the transfer of full containers.

3 Claims, 10 Drawing Figures

MACHINE FOR FILLING CONTAINERS

BRIEF SUMMARY OF THE INVENTION

The present invention relates to apparatus for filling containers with a liquid and more particularly to apparatus for filling beverage bottles with a carbonated beverage, for example, the type commonly known as a soft drink.

More particularly, the invention relates to a machine for filling containers with a liquid, the machine including a rotary filling unit on which the containers are transferred while being filled and being provided with a plurality, preferably two, of concentric rows of containers transferred on the filling unit during the filling operation. Still further, the invention relates to a method for supplying the containers to be filled to the rotary filling unit in such fashion as to insure that they will be located concentrically on the filling unit during the filling operation.

DETAILED DESCRIPTION OF THE INVENTION

It is known that the filling of containers with a liquid such as a soft drink or beer can be accomplished by delivering the containers to a rotary filling table upon which they are supported while being positioned beneath filling valves or nozzles. The usual practice has been to dispose the bottles beneath the filling valves in such a way as to form a single row of bottles in a circular series on the rotary filling table concentric with the filling unit. In one embodiment known in the art, the rotary filling mechanism is supplied with empty containers from a conveyor belt which feeds the bottles to a revolving star or a series of revolving stars to convey the bottles from the belt to the rotary filling unit. The rotary filling unit in turn comprises a number of circumferentially aligned filling valves which are positioned in the bottom of an annular tank or filling bowl. The filling valves transmit the liquid and whatever gaseous material is present under pressure into the containers. The filling unit revolves about a vertical axis which normally is the axis of the filling bowl.

In mechanisms of this type the bottles frequently are supported on individual platforms which may be adjusted vertically in order to engage the mouth of the bottle with the corresponding filling valve. Provision is made for moving the support vertically from a first position which generally is in the same plane as the transfer means for transferring the bottles from the conveyor belt to a second position which places the mouth of the container close to or in contact with the filling valve or filling mechanism and after completing the filling operation, to a third position that is generally on the same plane as the discharge means from the filling mechanism. This discharge means in turn transfers the full containers to a conveyor which removes them in a line and frequently leads to a closing or capping machine.

The output of a rotary filling machine is dependent upon the speed of rotation of the table and the filling operation as well as the number of filling valves present. Efforts have been made to increase the output of a filling machine of this type and it has been suggested that an increase can be obtained by either increasing the speed of rotation of the rotary filling apparatus or by increasing the number of filling valves on the filling apparatus with the resulting need for a larger apparatus.

Since an increase in the speed of rotation of the filling table results in increasing the centrifugal force, there is a tendency to tip the bottles and such an increase in speed introduces difficulties in properly transferring the bottles to and removing them from the rotary table. This of course also causes breakage of bottles and results in obstructions, vibrations and dislocation of bottles at the points of transfer from the conveying apparatus to and from the filling apparatus.

Likewise, there are difficulties in attempting to increase the number of filling valves provided in the annular tank. Enlarging the diameter of the table to increase the number of filling stations in a single annular row results in an increase in the peripheral speed of the bottles which leads to problems in handling the bottles before, during and after the filling operation. Additionally, an increase in the diameter of the filling machine has practical limitations, for example, the need for a larger floor area and because of the heavy load that is rotated, the necessity of heavier construction both of the machine and of its supporting foundation. Nevertheless, large filling machines are known whose tanks are equipped with, for example, as many as 100 circumferentially aligned valves which are aligned in a single concentric circle. In such a machine the tank diameter is so large that bottle handling difficulties are experienced. In particular, there is a tendency for the bottles to be displaced from their vertical filling position unless retention devices are provided which firmly maintain the bottles in the filling position. This illustrates the fact that if a sizeable increase in the tank diameter is made it is necessary to provide complex additional devices in order to insure proper handling of the bottles or containers.

Filling machines have been developed that deliver containers to a rotary filling table in two rows. For example, U.S. Pat. No. 2,775,269 discloses a filling machine that includes means to support containers on the filling table in two circular rows that are concentric with the axis of rotation of the filling table. Additionally, U.S. Pat. No. 3,047,032 discloses a filling machine having containers arranged in concentric rows and revolving about a central vertical axis.

Although it is known to fill containers on a filling machine on which the containers are arranged in concentric rows and revolve about a vertical axis, there has been a need for improved container feed methods to supply the empty containers to the filling machine from the conveyor belt or other empty container supply mechanism and to remove the filled containers from the filling machine. The present invention is directed toward an improved feed and take-off method for use in conjunction with rotary filling machines employing containers in concentric rows.

It is an object of the present invention to provide a machine for filling containers in which the containers are arranged in two concentric rows on the rotary filling apparatus. It is a further object of the present invention to provide for improved container infeed and take-off means to supply empty containers to a filling machine and to remove filled containers from the filling machine that overcomes difficulties encountered with known filling machines that fill containers arranged in two concentric circles.

In accordance with the present invention, there is provided a machine for filling containers with liquid which comprises an empty container infeed section, a filling section and a full container discharge section, the filling section comprising an annular tank for the liquid, rotatable around its own axis and a number of pairs of filling valves arranged substantially on a radius of the axis of the tank and having underneath each pair of valves support mechanism for the containers, rotatable in conjunction with the valves, which support mechanism receives containers from a transfer means in a first transfer section between the infeed and filling sections, the support mechanism comprising apparatus capable of changing vertical position to engage and disengage the filling mouth of the containers with the filling valves before the containers arrive at a second transfer section between the filling section and the discharge section, characterized in that the empty container infeed section is equipped with an infeed spider apparatus for the transfer of empty containers capable of receiving and discharging the empty containers by twos in substantially radial alignment with respect to the axis of the spider and a full bottle discharge means capable of withdrawing the filled containers at a second transfer section between the filling and discharge sections.

Figure 7:
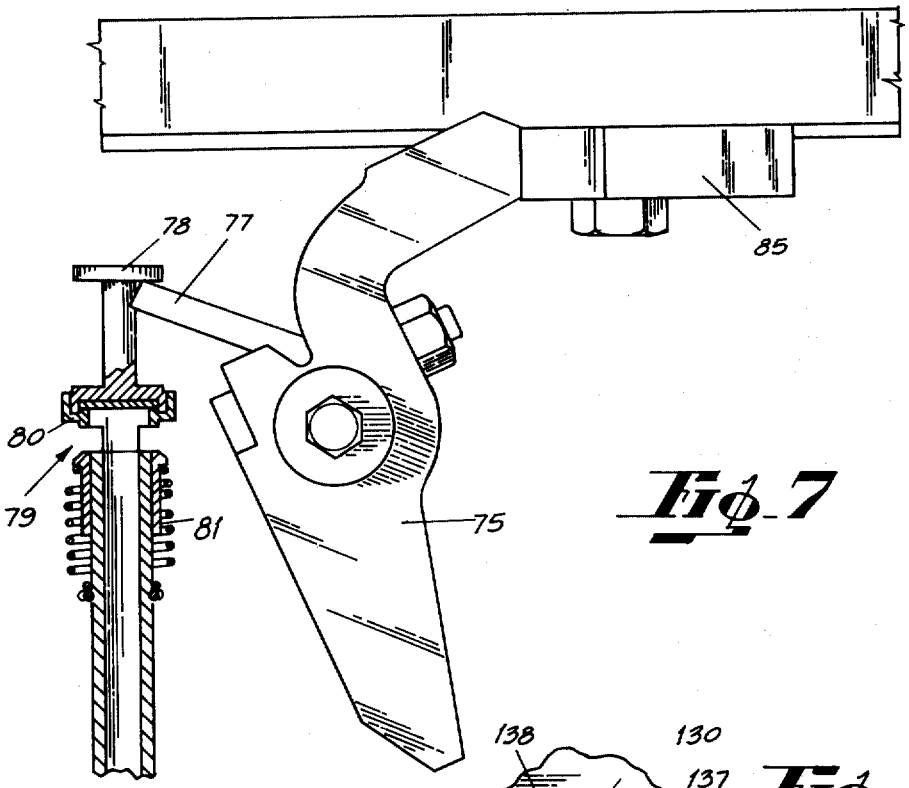
Figure 10:
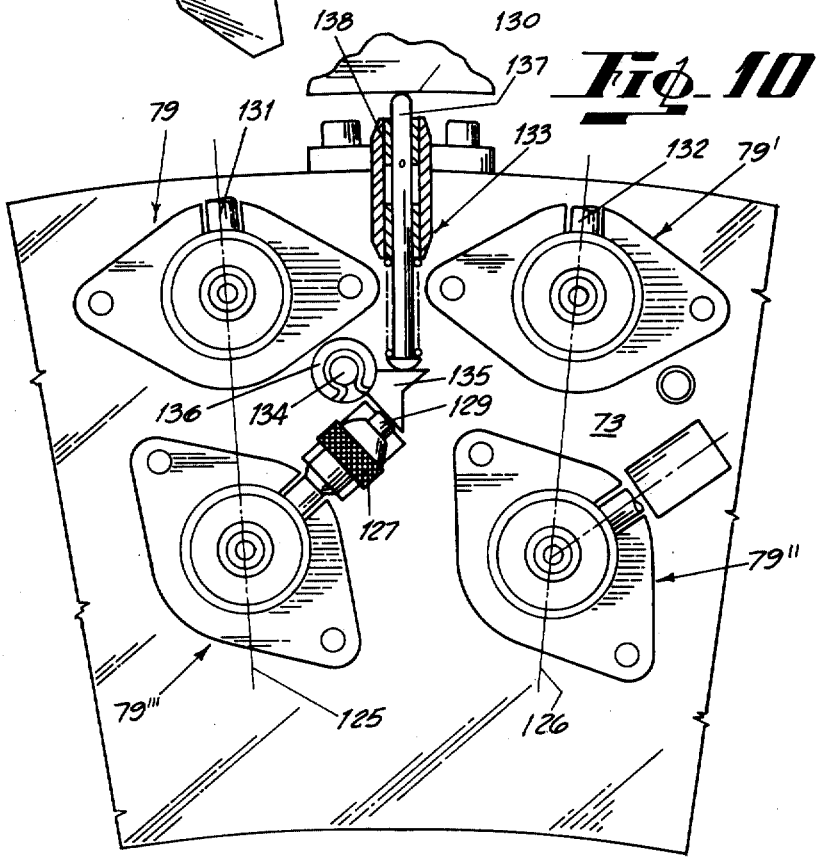
Figure 8:
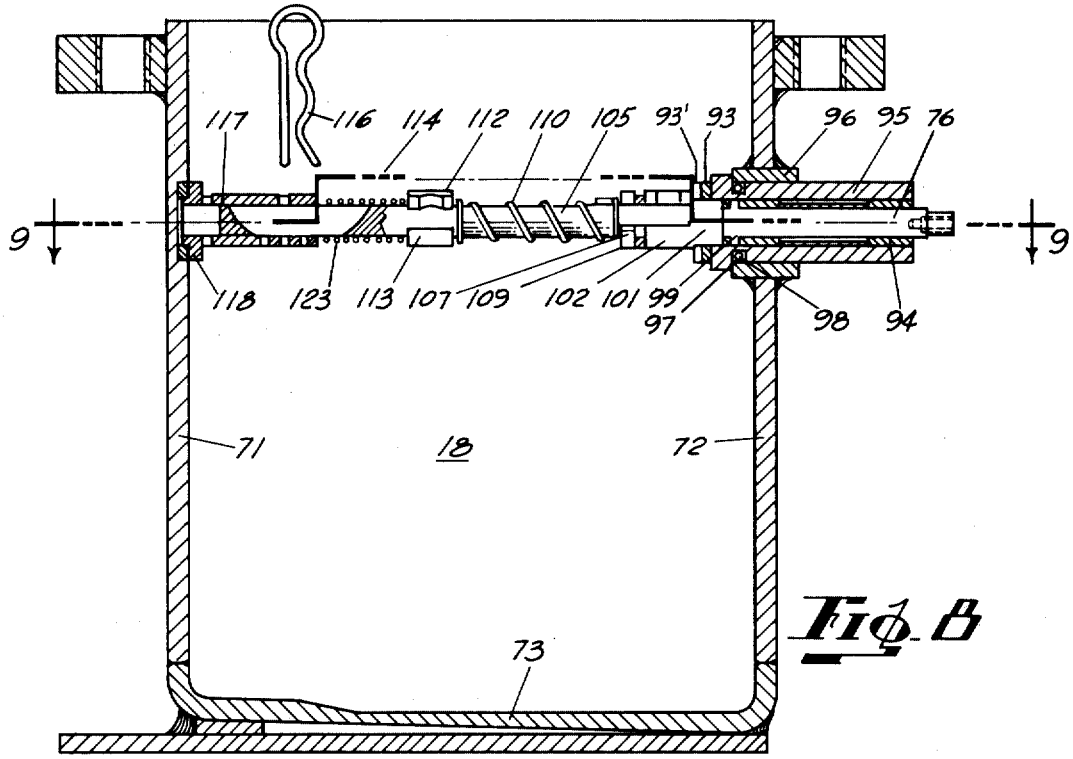
Figure 9:
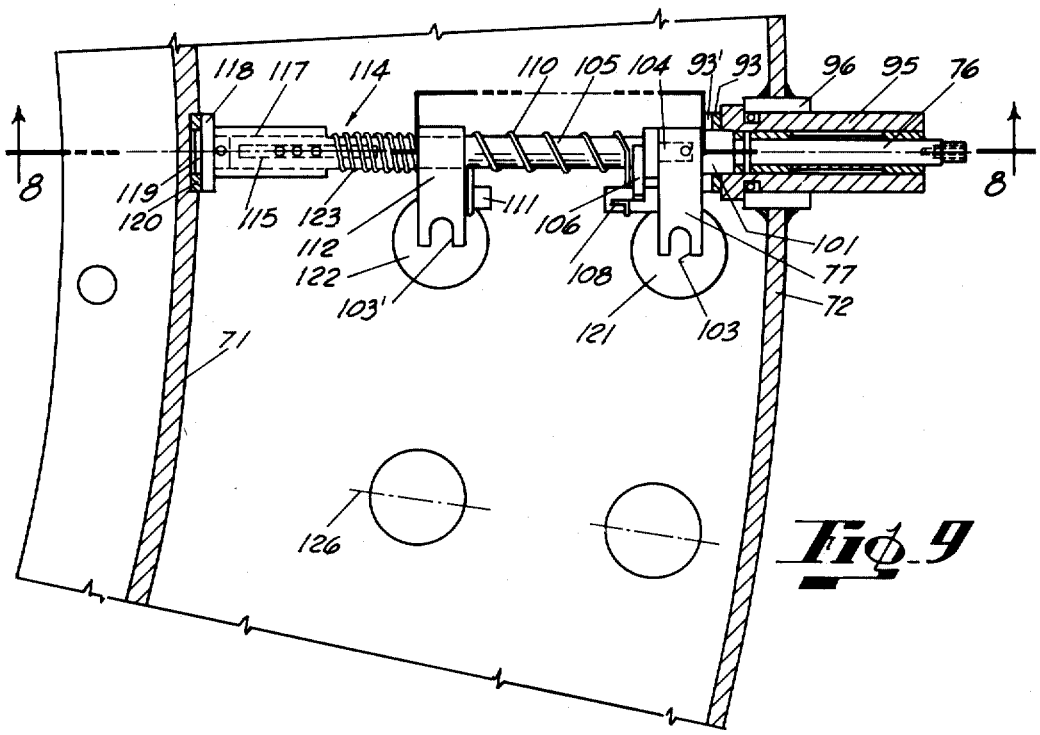

FIG. 7. is a side view of the operating lever of the common operating mechanism of a pair of valves, of one of which the upper part has been shown in a vertical and diametrical section; it also includes an illustration of part of the cam which acts together with the operating lever;

FIG. 8 is a section view along line 8—8 of FIG. 9 and corresponds substantially to a vertical and radial section through the liquid and gas tank, which was made through the operating mechanism of the pair of valves, which has not been shown so as not to make the drawing confusing; (several parts have been illustrated to facilitate their visualization);

FIG. 9 is a section view along line 9—9 of FIG. 8;

FIG. 10 is a view from underneath four filling valves with the pressure relief device and the operating mechanism of one of the valves.

In all figures, the same numbers apply to equal or equivalent parts.

Figure 1:
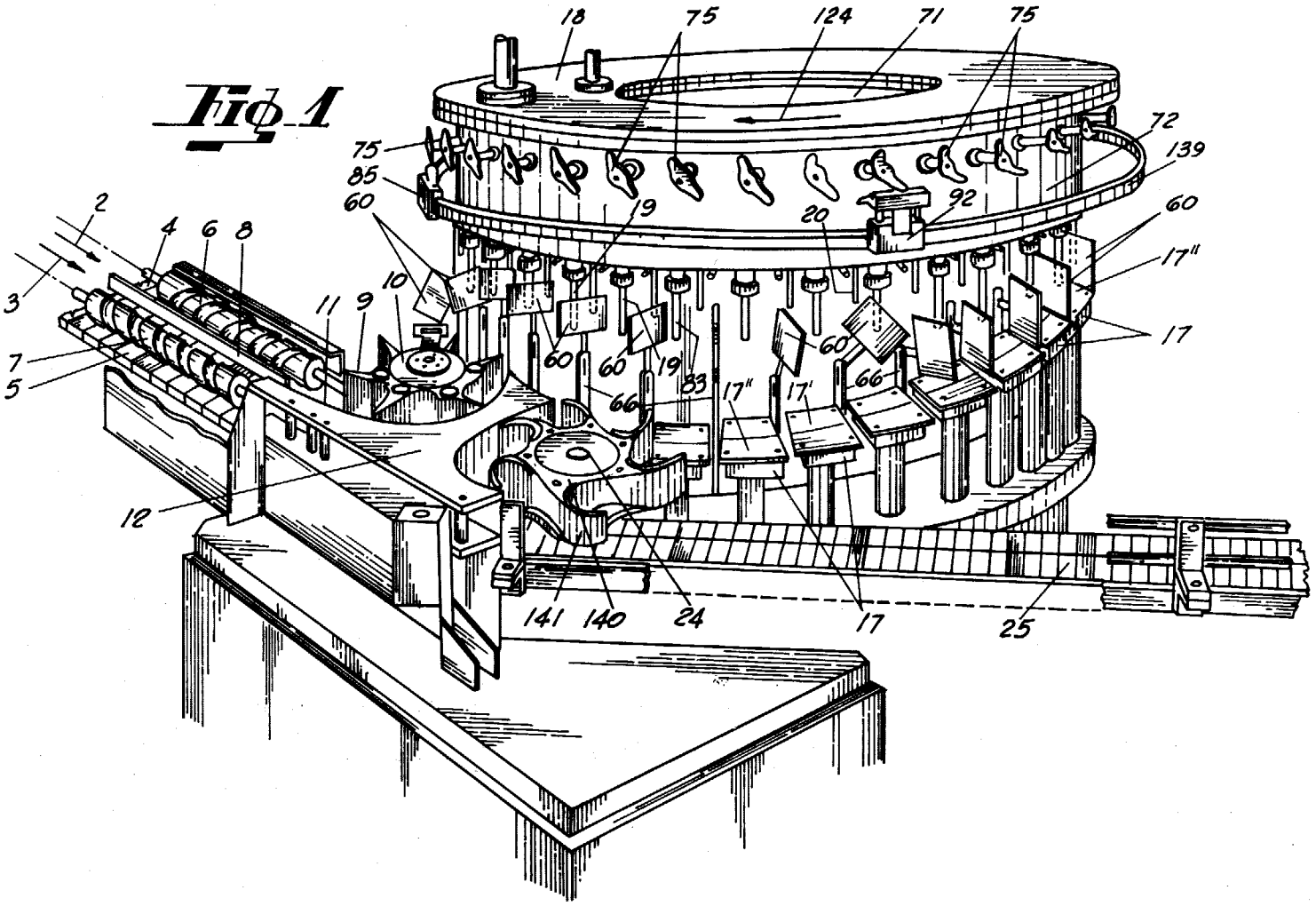
FIG. 1 is a perspective view of a filling machine in accordance with this invention, taken from the front, in which its basic components can be observed.
Figure 2:
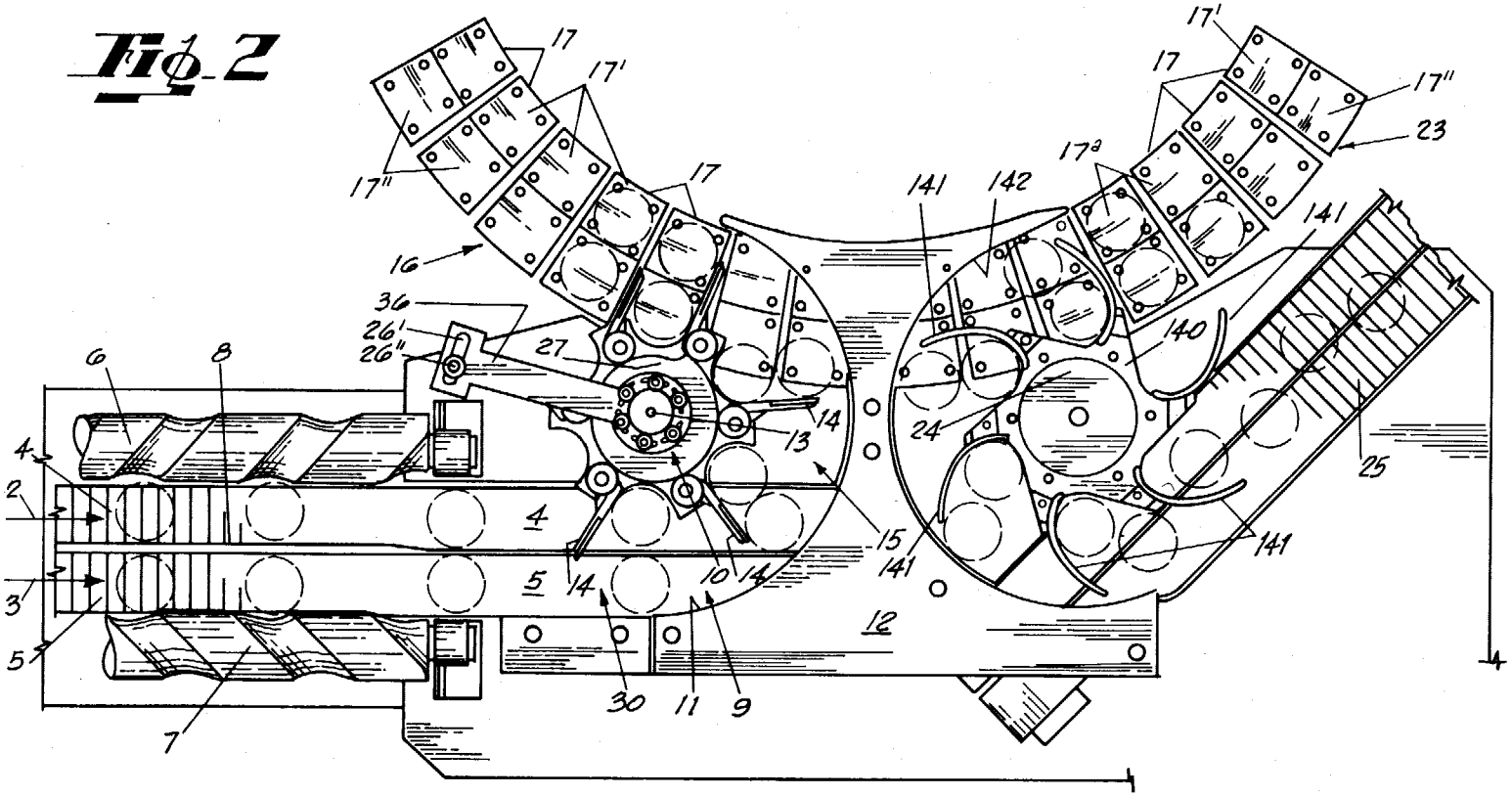
FIG. 2 is a plan view of part of the filling machine of the present invention, showing the bottle infeed, discharge, and transfer sections, with their principal parts, omitting for the sake of clarity anything referring to the filling mechanism proper.

FIGS. 1 and 2 illustrate the basic parts of the machine, leaving out other components which have no direct connection with the present invention.

In FIGS. 1 and 2, Arrows 2 and 3 indicate the feeding direction of the clean empty bottles on two conveyor belts 4, 5 to a pair of endless screws 6, 7, to be made preferably of a synthetic material, whose speed is prefixed to determine the spacing between the bottles which advance between each endless screw 6, 7 and a fixed intermediate guide 8 towards the infeed section of the filler.

The endless screws 6, 7 are set to turn at a speed synchronized with the speed of the conveyor belts 4, 5 which are below them, to assure the stability of the bottles. If desired it is possible to produce a positive or negative acceleration of the bottles with regard to conveyor belts 4, 5 by means of the endless screws 6, 7 in order to space the bottles in harmony with the spacing required by the infeed "spider" to be described hereinafter. On the other hand, both endless screws 6, 7 are phased so that the bottles leave the two endless screws 6, 7 arranged side by side and in twos.

It has been found preferable to have the endless screws 6, 7 turn clockwise and counter-clockwise respectively when seen in the direction of arrows 2, 3 so as to prevent the screws 6, 7 from tending to raise the bottles carried by them and thus causing their instability.

The bottles thus spaced are carried again by conveyer belts 4, 5 to the empty bottle infeed section 9, comprising the part of the infeed "spider" 10, which is superimposed on belts 4 and 5 and delimited by part of the guide side wall 11, which constitutes the external border of the trajectory to be followed by the bottles. It must be emphasized at this point that the linear speed of belts 4 and 5 in section 9 must be approximately equal by $-0+10\%$ to the tangential speed of "spider" 10 taken at the point of its arms which corresponds to the average distance between the center of each of the two bottles and rotation center 13 (FIG. 2).

Wall 11 forms part of a piece 12, that is fixed with regard to the frame of the machine and extends in the manner illustrated in FIG. 2. Each pair of bottles that comes from the endless screws 6 and 7 moves forward until it is aligned substantially on a radius of the rotational axis 13 of the infeed "spider" 10, in which position the bottles closest to axis 13 and then the other bottle (schematically represented in a broken line) are taken by one of the movable arms 14 of "spider" 10 which pushes them, forcing them, together with wall 11, to describe a curved trajectory in a transfer section 15 defined by the superposition between arms 14 and support mechanisms 17 (to be described hereinafter). This transfer section 15 connects infeed section 9 with the filling section which begins approximately where marked by the number 16.

The infeed "spider" 10 delivers the bottles pair by pair to one of a number of support mechanisms 17, which from there on support the bottles under a tank 18 equipped with a number of pairs of filling valves such as 19, 20, arranged in the lower part of tank 18 to connect its inside with a pair of bottles when the same are positioned with a pair of valves. Each pair of valves 19, 20 is aligned substantially on a radius of the symmetry axis 21 of the tank 18 and has a common operating mechanism 22, which will be described hereinafter in greater detail. Each pair of valves has an associated support mechanism 17, the valves 19, 20 being vertically aligned with a support mechanism 17. Each support mechanism 17 comprises a device capable of changing the vertical position of the bottles to connect and then disconnect their filling mouths with and from each pair of valves 19, 20 as the filling mechanism moves from the beginning of the filling section 16 to the end of this section, the approximate position of which has been identified by the number 23.

Tank 18 and the various support mechanisms 17, which are arranged in ring form under the tank, rotate around symmetry axis 21, and during this rotation, the bottles are filled with the carbonated liquid contained in tank 18.

Filled bottles are discharged from the filling section, which ends approximately where indicated by arrow 23, by means of a discharge "spider" 24, which transfers the full bottles to conveyor belt 25. The "spider" receives the bottles by twos from each support mechanism 17. The "spider" 10 is provided with movable arms, the positions of which can be controlled by a stationary cam 27 (FIG. 4), the construction of which permits a maximum opening 28 in section 9 in which the "spider" 10 receives the bottles from the aforementioned belts 4 and 5 and simultaneously a minimum separation 29 in the section in which the "spider" 10 delivers the bottles to the support mechanisms 17.

The infeed "spider" 10 comprises a central propeller axle 31 (FIGS. 4 and 5) on whose free end an axle 32 is mounted with the interposition of a cushion 33 and a socket 34.

Cam 27 is placed around axle 32 and is fixed by screws 35 to a synchronization arm 36, which has at one end a ring-shaped section 37 incorporating a number of swivels 38, through which pass the screws 35. Screws 35 also pass through a radial flange 39 of axle 32 to assure its fixed position, permitting axle 31 to revolve by the interposition of cushion 33 and socket 34. The end of axle 31 is plugged by a socket 40, which covers cushion 33 and axle 32. On its other end, the synchronization arm 36 is adjusted to the frame of the machine (see FIG. 2), to which end it has an enlarged section in which a swivel 26' is placed, which is passed by a screw 26'' that fixes the position of arm 36 with respect to the frame of the machine.

Since arm 36 is provided with a system that permits the fixing of varying positions at both its ends, it is possible to set the machine as desired. To do this, the position of arm 36 with regard to the machine can be changed by loosening screw 26'' which fixes its end to the frame of the machine and by shifting this end with the help of swivel 26'. The relative position between arm 36 and cam 27 can be modified by loosening screws 35 and turning the cam 27 and the axle 32 relative to the arm 36.

Axle 31 is provided with flange 31', which is provided with swivels 31'', the position of which coincides with equivalent swivels formed on a "spider"-bearer 41. The swivels 31'' and the swivels on the "spider"-bearing 41 are crossed by control screws (not shown), which permit changes in the relative position between cam 27 and star 43 still to be described.

The "spider"-bearing 41 supports star 43 by means of stud bolts 42, from which protrude, parallel to the rotational axle 13, six axles 44 fixed to star 43 by means of a locking nut 46, with interposition of a safety socket 45. The axles 44 jut out from the upper part of star 43 and have a flange 47, which, together with locking nut 46, serves to fix each of the axles 44 to star 43. Flange 47 is surrounded by socket 48, whereas section 49 of each of the axles 44 is surrounded by a cushion 50 which permits the angular movement of an L-shaped arm 51, which, on its shorter side, by means of an elastic plug 52, supports an axle 53 surrounded by a cushion 54 around which a roller 55 is placed in such a manner that its rolling surface rolls on the cam surface of cam 27. Roller 55 is held on axle 53 by packing 55'.

Figure 4:
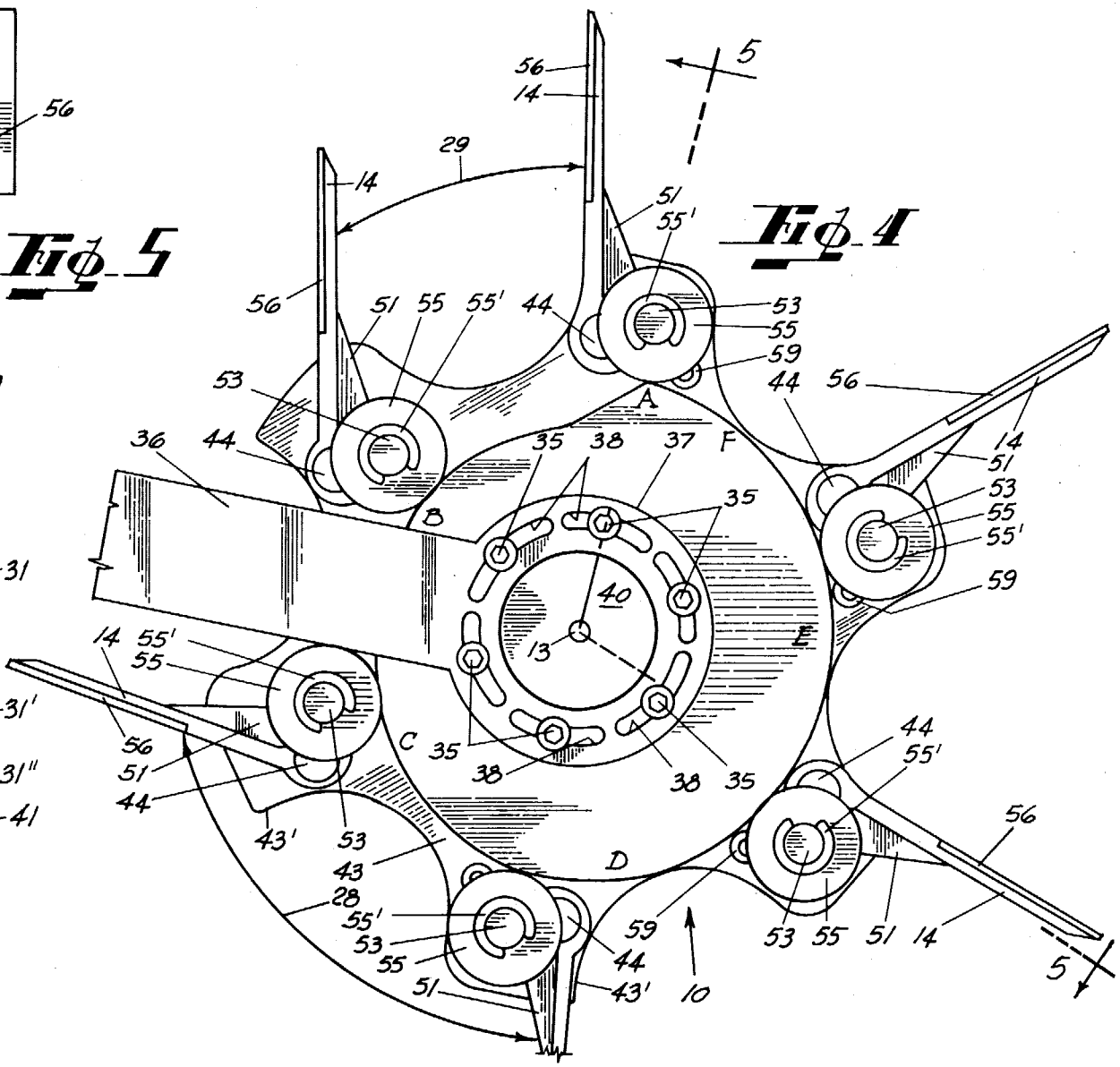
FIG. 4 is a plan view of the novel infeed "spider" with its operating cam.
Figure 5:
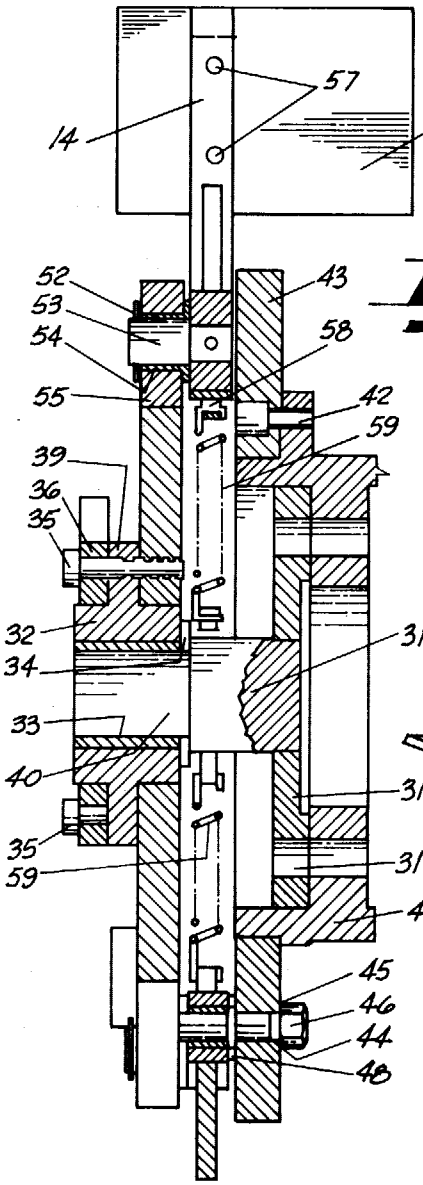
FIG. 5 is a sectional view along line 5—5 in FIG. 4.

Arm 51, which protrudes from the periphery of the star 43, has a protruding part, generically identified as arm 14 in FIGS. 1, 4 and 5. On the free end of each arm 51, a flat pressure plate 56 is fixed by means of screws 57.

Contact between rollers 55 and the surface of cam 27 is maintained with the help of draw-springs 59, which bias rollers 55 to the geometrical center of axle 31. Springs 59 are connected through loops 58 with the arm 51 and the axle 31, respectively.

The star 43 has butt ends whose number coincides with the number of arms 14. Each arm 14 is mounted as described above and has its individual cam guide mechanism. To achieve this, each of the six axles 44 is mounted on one of the pointed sections of star 43.

Moreover, star 43 is provided with six cavities, one between every two pointed sections, which receive the bottles (one in each cavity) that are closest to axle 13. In order to assure the best possible delivery of these inside bottles, edge 43' must have a substantially straight border to prevent the poor positioning of the bottle on the support mechanisms 17.

Means must be provided that permit the independent regulation of deliveries to the support mechanisms 17 of the bottles closest to axle 13 ("inside" bottles) and the bottles more distant from this axle ("outside" bottles).

To vary the infeed position of the "outside" bottles, it is necessary to vary the angular position of the cam 27, since it is this cam which affects the displacement of the arms 14.

The machine is provided with mechanisms to adjust the position of the cam 27, which mechanisms consist on the one side of the synchronization arm 36, its swivel 26' and the screw 26'', by means of which the position of arm 36 is fixed, and on the other side, of the ring-shaped section 37, the swivels 38 and the screws 35, by means of which the relative position of the cam 27 is fixed with respect to the arm 36.

In order to vary the position in which the "inside" bottles are delivered, the angular position of the "spider" 43 must be regulated with respect to the axle 31, to which end swivel 31'' is provided and its corresponding swivel confronted and defined by "spider"-bearer 41. It is evident that by loosening the screws which go through these swivels (not shown), it is possible to shift the "spider"-bearer 41 with respect to the axle 31. Once these pieces have been set in the desired position, they can again be adjusted by means of the screws.

The profile of cam 27 can be divided into six sections, identified by the letters A, B, C, D, E and F, by means of which one obtains the following movement of the arms 14. Immediately after point A, the arm 14 moves backward rapidly releasing the bottles which it conducts, and which from there on are carried by the support mechanism 17, while the aforesaid arm begins to pull back between two successive pairs of bottles, as shown in FIG. 2. Between sections A and B, the two adjacent arms can, by reducing the distance 29, prevent any bottle from advancing, thus assuring the correct positioning of each pair of bottles on each support mechanism. In B, the arm, which is already beyond the possibility of contact with the bottles, is accelerated uniformly, with its external end advancing. This acceleration changes its sense in C, from where on to D the arm 14 advances in a decelerating manner to produce the opening 28 which permits infeeding two bottles side by side. In D, the arm regains its radial position, in which it will accompany the bottles on a circumferential course along the section marked E, beginning in F to decelerate the outside bottle in order that, once the desired speed is reached, the arm delivers the bottle in A to support mechanism 17.

By means of this arrangement, it is possible to deliver the outside bottle (E or F) in a suitable manner, to carry both bottles on a parallel to the guides (between D and F), to avoid obstructions and breakage, to withdraw the arms 14 without touching the bottles (in B) and to prevent outside bottles from advancing when they have been "decelerated" (between F and B).

Screen Retractor Mechanism

As shown in FIG. 1, the machine is equipped with a number of separator screens 60, which are arranged on vertical radial planes with regard to the symmetry axis 21 and aligned circumferentially around the filling mechanism under tank 18, and at equal distance between the plans which contain two adjacent pairs of valves 19 and 20. Each of these screens 60 is arranged on a plane that passes between two support mechanisms 17, thus forming front and back walls for each pair of bottles held on the support mechanisms 17. These screens are retracted in the sections where the bottles are fed into and discharged from the filler proper so as to permit the infeed and discharge. During the rest of the bottle trajectory, as illustrated in FIG. 1, the screens remain in such a position that, without touching the bottles, they prevent the accidental failure of a bottle from being transmitted to other bottles.

Figure 3:
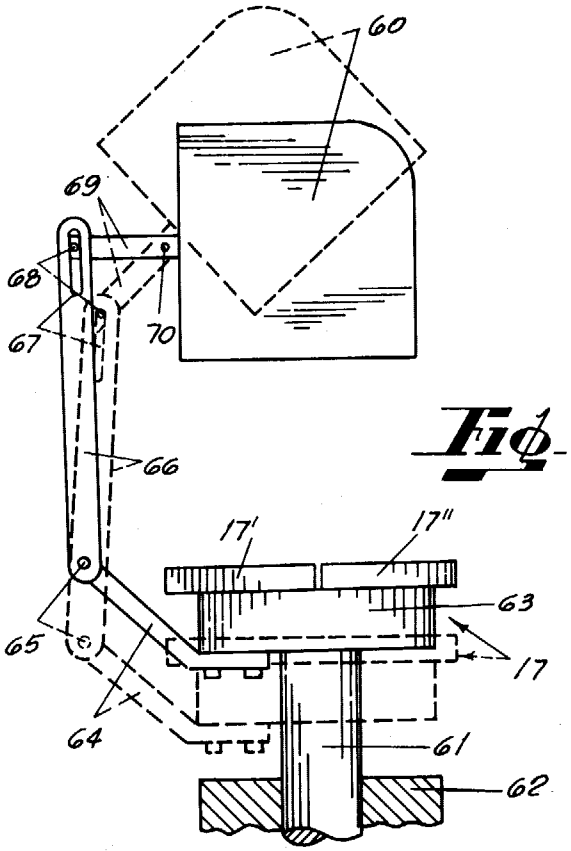
FIG. 3 is a side view of the screen retractor.

FIG. 3 shows the connection between each screen and each support mechanism 17 to permit screen retraction in a manner synchronized with the movement of the support mechanism.

Each support mechanism 17 comprises a sliding piston 61 within a cylinder 62, which is connected with a source generating fluid under pressure which in a controlled manner causes piston 61 to rise or fall.

The piston 61 is connected with a swing-bar mechanism contained by ring 63 and having rigid arm 64, the free end of which is at 65 connected with one end of connecting rod 66, at whose other end is swivel 67, within which sliding pin 68 is arranged, which is connected to arm 69, mounted rotarily around the axle 70 and fitting into the screen 60.

When piston 61 is displaced vertically, a vertical displacement of connecting rod 66 occurs pulling (when the movement is downwards) pin 68 and causing the counter-clockwise rotation of screen 60 around axle 70, carrying it to the position which is represented in FIG. 3 by a broken line.

The upward movement of piston 61 is produced in order to connect the mouths of the pair of bottles arranged on the support mechanism 17 with the valves 19, 20 at the beginning 16 of the filling section, maintaining the bottles in that position to the end 19 of the filling section. This upward movement causes the screens 60 to drop, whereby they are placed between each pair of bottles.

Once the bottles have been filled, support mechanism 17 descends to the level of conveyor belt 25, thus permitting the discharge "spider" 24 to transfer the bottles from the support mechanisms to the conveyor belt 25. Because the bottles must be completely free from interference from the screens 60, the screens are retracted at a position more extreme than the one shown in FIG. 3, which can be observed on the forepart of the machine illustrated in FIG. 1.

The swing-bar mechanism contained by ring 63 serves to compensate any differences in height between the two bottles which are upheld by each support mechanism 17. It is possible, of course, to provide, in lieu of a swing-bar mechanism, a piston 61 for each bottles, or else an elastic assembly system between a single piston 61 and the support plates 17', 17" of each support mechanism 17.

Filling Valves

As shown in FIGS. 1, 6, 8 and 9, the filling valves are arranged by twos with a common operating mechanism 22. These valves may be similar in construction to the valves known in the industry.

Figure 6:
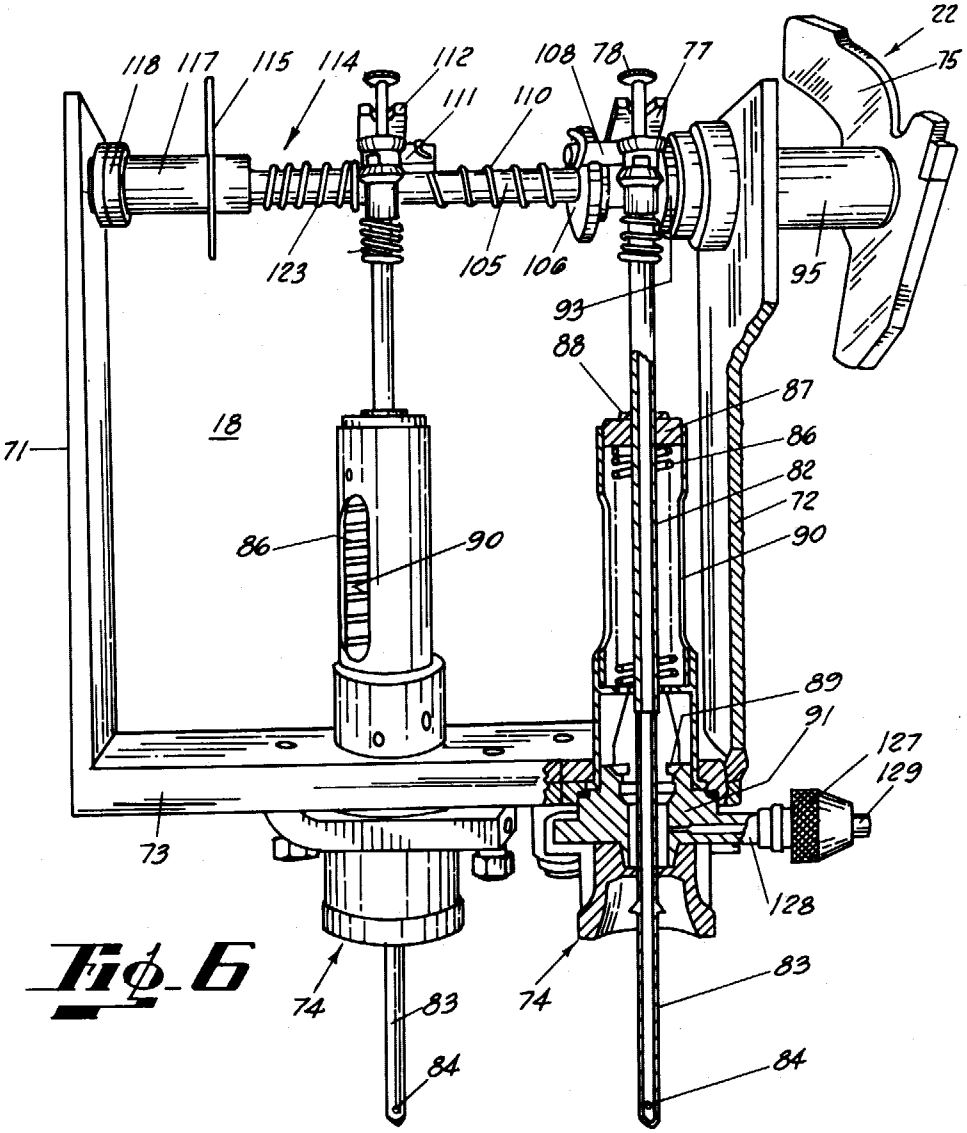
FIG. 6 is a perspective view of a pair of filling valves with their common operating mechanism, one of which has been illustrated partially in a vertical and diametrical section to show its construction details.

Each of these pairs of valves 19, 20 is mounted in the tank 18, which in FIG. 6, is shown with an open upper part and has an internal side wall 71, an external side wall 72 and a bottom 73. The bottom 73 is traversed by the valves 19, 20 to connect the inside of the tank 18 with the bottles which are sealed to the respective spouts 74 of each valve.

The common operating mechanism 22 of each pair of filling valves comprises an outside lever 75, which actuates the rotation of a shaft 76 that penetrates into tank 18 and whose end inside the tank is attached to operating arm 77 to transmit a rotary movement to the latter. The end of arm 77 is forkshaped and fits under head 78 of the gas valve 79 (FIG. 7), to which it imparts an upward and downward motion. The valve 79 comprises moreover a seat 80 and a port 81. The upward linear course of the head 78 releases the flow of the gas from inside the tank 18 towards the bottles through the hollow tube 82, which continues in the pipe 83, the lower end of which has a perforation 84. The outside protuberance 85 (FIGS. 1 and 7) causes the rotation of outside lever 75, thereby raising the gas valve and permitting the inflow of gas through the hollow tube 82, the pipe 83 and the perforation 84 towards the bottle which stands with its mouth sealed to the rubber fitting 74. As soon as the pressures inside tank 18 and the bottle are equal, the spring 86 raises the guide-ring 87, which, with the help of the ratchet 88, raises the hollow tube 82 jointly with the seat 89, permitting the beverage contained inside the tank 22 to drop through the vent 90 and between the seat 89 and the valve body 91.

When the desired filling height, which is determined by the level of the perforation 84, is reached, the flow of the gas from the bottle back to the tank through the perforation 84, the pipe 83 and the hollow tube 82, which takes place while the bottle is being filled with the liquid, is stopped. This occurs when the liquid inside the bottle reaches the level of perforation 84. Since the liquid cannot dislodge the gas in the bottle, its flow is held back because of the limited space existing between the seat 89 and the valve body 91. This effect is achieved because of the surface tension of the liquid and the limited dimensions of the passage between seat 89 and valve body 91. At this instant, or very shortly thereafter, another protuberance 92 (FIG. 1) acts in the direction contrary to the outside lever 75 and the arm 77 forcing the gas valve to close. This action also causes the snapping of the seat 89 against the valve body 91.

Almost simultaneously, an outside strip, which will be described hereinafter, acts on a pressure relief valve (FIG. 10) reducing the pressure inside the bottle.

The need to actuate two valves from one single point of control is preferable to doing so by means of two independent operating mechanisms. Since lever 75 and arm 77 are rigid, it is not possible to assure the closure of the two valves of each pair at the same time, because, for reasons of size, the valves may remain at different heights, with differences of less than one millimeter between them.

Since it is not possible to reduce the manufacturing tolerances of the valve pieces, and since incorrect closure of a gas valve would cause the beverage to foam profusely, thus causing a waste of product, it is necessary to provide a mechanism in which the operation of the two valves is independent of their height once they have been installed with a tolerance of less than two millimeters.

Outside lever 75 is connected with axle 76 which, by means of a first cushion 94, is mounted inside a second cushion 95 retained in external side wall 72 by means of a third cushion 96 attached to external side wall 72.

Cushion 95 has a groove 97 containing a closing ring 98, which blocks the contact between the common surfaces of cushion 96 and the cushion 95 to prevent the leakage of gas or liquid between them.

A packing 99 is provided around axle 76, which keeps in position another closing ring 100, which also prevents the flow of liquid or gas between cushion 95 and axle 76.

Axle 76 has a first enlarged section 101 which is also set to hold back the closing ring 100.

After the first enlarged section 101, the axle has another enlarged section 102, which a tangentially fixed arm 77, at the free end of which forked portion 103 is provided.

Between the cushion 95 and the enlarged section 102, two packings 93, 93' are located, the one made of metal, the other of Teflon.

The section 102 of axle 76 is provided with an axial recess 104, into which fits, with a free rotary movement, one end of a complementary axle 105, coextensive with the axle 76, from which a spoke 106 protrudes radially, which spoke has at its free end an opening 107 containing a pin 108 which is in contact with the arm 77 and parallel to the complementary axle 105. The diameter of the pin 108 is slightly smaller than the distance between the side walls of the opening 107, so that a space 109 remains which permits a relative slight angular movement between the complementary axle 105 and the axle 76.

Around the axle 105, a helical spring 110 is placed, one of whose ends is connected with pin 108, while its other end is connected with pin 111, which is in contact with a valve operating arm 112 fixed tangentially to a widening 113 of the axle 105.

Due to the action of spring 110, the arms 77 and 112 are slightly "disphased" at a distance of approximately 1.5 and 2 mm. in their forked part, for the purpose which will be seen hereinafter.

At the end 114 of the axle 105, a slot 115 has been provided to receive an elastic bolt 116, which passes through a small cushion 117 arranged on the end 114 in such a manner as to make the small cushion 117 axially movable with respect to the axle 105. The small cushion 117 presents a widening 118 and a guide and support section 119 rotarily mounted within a cushion 120 which is solid with the internal side wall 71.

Between the widening 113 and the small cushion 117, and around the axle 105, a compression spring 123 is interposed which, once the unit has been assembled, holds the guide and support section 119 inside the suchion 120. To disassemble axle 105 and its complementary pieces, all that is necessary is to slide the small cushion 117 to the right, following the direction shown in FIGS. 8 and 9, and thus to tilt the axle 105 with regard to its operating position, withdrawing it from axial perforation 104.

As shown in FIG. 9, centered under each forked portion 103, 103', the openings 121, 122 have been provided at the bottom 73 of tank 18, within each of which perforations a filling valve is mounted, as shown in FIG. 6.

With the help of the operating mechanism described herein, when the outside lever 75 is rotated clockwise and contacts with outer protuberance 85, axle 76 rotates clockwise, thus lifting the forked part of the arm 77 which, in turn, raises head 78 opening the gas valve which is next to the external side wall 72, i.e., the radially external valve.

Due to the connection between axle 76 and complementary axle 105, the latter also rotates clockwise when pulled by arm 77, pin 108 and spoke 106. In this manner, arm 112 also performs a clockwise angular movement, opening the radially internal valve. No disphasing is caused in the opening of the internal valve with regard to the external valve, since the helical spring 110 holds the pin 108 against the upper surface of the opening 107, so that, when the arm 77 moves clockwise, it permits the simultaneous rotation of the arm 112.

When the outer lever 75 is turned counter-clockwise by the external protuberance 92, the axle 76 likewise turns counter-clockwise, closing the gas valve 79 which is next to the external side wall 72. The arm 112, at the height of its forked part, is more advanced by between 1, 5 and 2 mm than the arm 77 at the height of its corresponding forked part. This is due to the fact that the helical spiral 110 stretches to produce a corresponding rotation of the arm 77 with regard to the arm 112 in contrary directions. This actuates in the first place the valve 79, mounted inside the perforation 122, regardless of its height within the manufacturing tolerances, and immediately thereafter closes the filling valve mounted in the perforation 121.

Because of the need to assure the independent working of each valve 79 coupled to the common operating mechanism 77, a trigger of regulable height (not shown) is provided and placed, in the revolving direction of the tank 18 (represented by Arrow 124), after the cam 85 and before the external protuberance 92 to cause the return of the lever 75 to an intermediate position between the positions corresponding to the opening and closing of the valves 79. In this fashion, the arms 77 and 112 remain in the positions shown in FIG. 6, which permit the opening of the liquid valves 89, 91 and also lend freedom of movement to the head 78. In case of failure of one of the bottles sealed to the rubber spouts 74, the pressure within the pipe 83 collapses immediately, closing the valve 79 by the action of the gas which tends to escape through the pipe 83. Due to the opening 109, whose size is fixed for the purpose, the arm 77 or 112 of the valve 79 which closes immediately, does not pull the other arm 112 or 77, respectively, so that no interruption occurs in the flow of gas and liquid to the unharmed bottle. The aforementioned trigger of regulable height must be calibrated in position in such a manner as to carry the axle 76 and the complementary axle 105 to a position permitting the independent closure of the valves taking advantage of the opening 109 as already described.

Operating Mechanism of the Relief Valves

Referring now to FIG. 10, it shows four valves 79, 79', 79'' and 79''', arranged by twos over radii 125 and 126, which converge in the center 21.

Each valve 79, 79', 79'', 79''' is provided with a pressure relief mechanism 127.

These pressure relief valves comprise a hollow body 128 within which an elastically supported valve plate is mounted. This plate is pulled out of its seat by pushing the button 129, whereupon the inside of the spouts 74 and thus the inside of the bottle is brought into contact with the outside. These relief valves are well known and do not form part of the present invention.

Nevertheless, in the machine covered by this invention, it has not been possible to place the relief valve 127 of each valve 79 in the conventional position, because valves 79'' and 79''' are distant from cam 130, schematically represented in FIG. 10, which serves to act on the buttons 129. In the conventional machines, as also in this machine, the relief valves 127 corresponding to the valves 79 and 79' would be placed in the positions indicated by the numbers 131 and 132.

To permit the relief of valves 79'' and 79''', the relief valves are placed in a position in which they are slanted with regard to radii 125 and 126 so that button 129 remains on another radius substantially equidistant from radii 125 and 126 and in a position suitable to receive the movement transmitted by a movement transmission device 133. This movement transmission device 133 includes pin 134 connected to the bottom 73, which protrudes perpendicularly into the same. On pin 134, an intermediate piece 135 is mounted, which is kept in position by means of an elastic packing 136. One of the surfaces of intermediate piece 135 presses against button 120, whereas the other surface contacts the head of a rod 137, movably mounted inside a cushion connected to the tank 18. Around rod 137, a spring is placed which assures the permanent contact between button 129, intermediate piece 135 and the head of rod 137. When contact is established between the cam 130 and the outside end of rod 137, the latter performs an axial movement, displacing the intermediate piece 135 and acting on the button 129 in a way opening the relief valve. Proper timing for pressure relief is attained by locating cam 130 properly on railing 39, which also supports cam 85, the protuberance 92 and the aforementioned adjustable trigger.

Discharge "Spider" 24

The transfer of bottles in pairs from supporting mechanism 17 to conveyor belt 25 is carried out by means of the discharge "spider" 24. This "spider" has a central body 140, from which project equidistant curved arms, the configuration of which has been selected to permit them to penetrate between each two pairs of bottles arranged on two adjacent support mechanisms 17, to pick up the two bottles, remove them together, and, with the help of the wall 142, carry them to a position in which the outside bottle which is the one first to be placed on the conveyor belt 25, is advanced with rectilinear speed, whereas the inside bottle is still advanced in a curvilinear movement. Later the linear speed of the belt 25 is sufficient to push the inside bottled ahead, so that all bottles are placed on the conveyor belt 25 in a staggered arrangement.

While certain desirable embodiments of the invention have been illustrated and described by use of example, it is to be understood that the inventions is intended to be broadly inclusive of any and all modifications falling within the scope of the attended claims.

I claim:

1. A machine for filling a plurality of containers by twos with a liquid which comprises an empty container infeed section, a filling section and a full container discharge section, the filling section comprising an annular tank for the liquid, rotatable around its own axis of symmetry, and a number of pairs of filling valves arranged substantially on a radius from the axis of symmetry of the tank and having underneath each pair of valves support mechanisms for the containers, rotatable in conjunction with the valves, which support mechanism receives containers from a transfer means in a first transfer section between the infeed and filling sections, the support mechanism comprising apparatus capable of changing vertical position to engage and disengage the filling mouth of the containers with the filling valves before the containers arrive at a second transfer section between the filling section and the discharge section, said empty container infeed section being equipped with an infeed spider apparatus capable of receiving and discharging empty containers by twos in a substantially radial alignment with respect to the axis of the infeed spider and with said infeed spider apparatus comprising of a star mounted on a propelling axle on which a series of arms are mounted in an angularly movable manner, the arms jutting out from the periphery of the star and supporting a roller each, the rolling surface of each roller resting on a cam surface, stationary with respect to the machine, the aforesaid star apparatus having peripheral cavities which, in combination with the said arms, are capable of receiving two containers, the centers of which are substantially on a radius of the center of the aforesaid propelling axle, and of delivering them in an arrangement in which their centers are substantially on a radius of said symmetry axis whereby the containers are transferred from the empty container infeed section to the container filling section and a full bottle discharge means capable of withdrawing the filled contained by twos at a second transfer section between the filling and discharge sections.

2. A machine according to claim 1 wherein the cam is in an adjustable angular position.

3. A machine according to claim 1 wherein the full bottle discharge means comprises a central body from which a number of equidistant curved arms protrude.

* * * * *